US007005042B2

(12) United States Patent
Danzler

(10) Patent No.: US 7,005,042 B2
(45) Date of Patent: Feb. 28, 2006

(54) NIP PRESS BELT

(75) Inventor: Franz Danzler, Neustadt (AT)

(73) Assignee: Stowe Woodward AG, Duren (DE)

( * ) Notice: Subject to any disclaimer, the term of this patent is extended or adjusted under 35 U.S.C. 154(b) by 58 days.

(21) Appl. No.: 10/476,339

(22) PCT Filed: Sep. 17, 2002

(86) PCT No.: PCT/EP02/10441

§ 371 (c)(1),
(2), (4) Date: Oct. 29, 2003

(87) PCT Pub. No.: WO03/025282

PCT Pub. Date: Mar. 27, 2003

(65) Prior Publication Data

US 2004/0144515 A1 Jul. 29, 2004

(30) Foreign Application Priority Data

Sep. 17, 2001 (EP) ..... 01122208

(51) Int. Cl.
*D21F 3/02* (2006.01)
*D21G 1/00* (2006.01)

(52) U.S. Cl. ..... 162/358.4; 162/358.3; 162/901; 100/153

(58) Field of Classification Search ..... 162/116, 162/117, 205–207, 358.1, 358.2, 358.3, 358.4, 162/361, 901; 428/156, 163, 167, 297.4, 428/332, 339, 107–111, 213, 215, 217, 220; 100/151, 153
See application file for complete search history.

(56) References Cited

U.S. PATENT DOCUMENTS

| | | | | |
|---|---|---|---|---|
| 412,656 | A * | 10/1889 | O'Neill | 162/360.2 |
| 3,685,436 | A | 8/1972 | Mitchell, Jr. | 100/37 |
| 4,431,045 | A * | 2/1984 | Josefsson | 162/358.3 |
| 4,483,745 | A | 11/1984 | Wicks et al. | 162/205 |
| 4,552,620 | A | 11/1985 | Adams | 162/358 |
| 4,559,258 | A * | 12/1985 | Kiuchi | 428/156 |
| 4,908,103 | A | 3/1990 | Cronin et al. | 162/358 |
| 4,976,820 | A * | 12/1990 | Laapotti | 162/206 |
| 5,507,899 | A * | 4/1996 | Watanabe et al. | 156/154 |
| 5,836,242 | A * | 11/1998 | Aberg | 100/327 |
| 6,083,349 | A | 7/2000 | Schiel | 162/206 |
| 6,086,719 | A * | 7/2000 | Hasegawa et al. | 162/358.4 |
| 6,616,814 | B1 * | 9/2003 | Best | 162/358.4 |

FOREIGN PATENT DOCUMENTS

| | | |
|---|---|---|
| DE | 40 28 085 | 9/1990 |
| DE | 42 02 731 | 1/1992 |

(Continued)

OTHER PUBLICATIONS

PaperHelp Online, Hardness, section 17.4, https://www.paperloop.com/pp_mag/paperhelp/17_ 14_key.shtml.*

(Continued)

*Primary Examiner*—Eric Hug
(74) *Attorney, Agent, or Firm*—Myers Bigel Sibley & Sajovec

(57) ABSTRACT

Nip press belt (9) of a wet press (1) or a calender with elongated nip, in particular for a paper, cardboard or tissue machine, with a flexible carrier layer (9*a*) that is impermeable to liquids and is made of soft rubber having a hardness in the range between 20 and 50 P+J and an integrated textile reinforcement (9*b*), and with a covering layer (9*c*) that is fixedly connected to the carrier layer or formed together therewith.

14 Claims, 1 Drawing Sheet

FOREIGN PATENT DOCUMENTS

Figure 1:
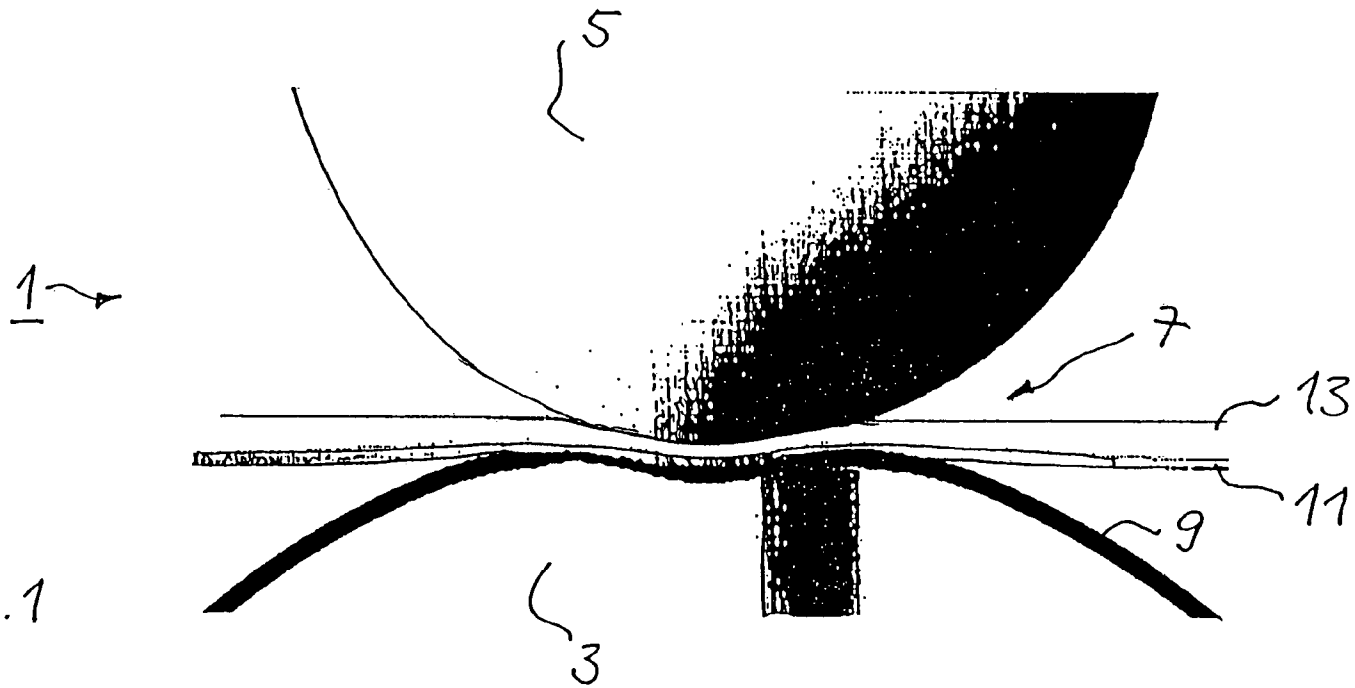

| | | |
|---|---|---|
| DE | 44 38 354 | 10/1994 |
| DE | 299 23 825 | 11/1999 |
| EP | 0 258 759 | 3/1988 |
| EP | 0 289 477 | 4/1988 |
| EP | 0 420 372 | 4/1994 |
| EP | 0 877 118 | 2/1998 |
| EP | 0 939 162 | 9/1999 |
| EP | 1 085 125 | 9/2000 |
| WO | WO95/16820 | 6/1995 |
| WO | WO00/12205 | 3/2000 |

OTHER PUBLICATIONS

Search Report PCT/EP02/10441 (Sep. 17, 2002).

* cited by examiner

NIP PRESS BELT

This application claims priority under 35 U.S.C. §371 from PCT Application No. PCT/EP02/10441, filed on Sep. 17, 2002, which claims the benefit of European Application Serial No. 01 122 208.0 filed on Sep. 17, 2001, the disclosures and contents of which are incorporated by reference herein in their entireties.

DESCRIPTION

The invention relates to a nip press belt according to the precharacterizing clause of Claim 1.

A nip press belt of this kind, in German also called Preβmantel (translatable as "press jacket"), is used in paper, cardboard or tissue machines to remove most of the water from the product concerned (wet press) or to finish the surface (calender). Such presses or calenders have an elongated press gap ("nip") and are therefore also called "nip presses".

Within the nip the press belt makes sliding contact, by way of its back (lower) surface, with the actual pressing element; therefore this back surface must have excellent sliding properties. On its front (upper) surface the press belt makes contact either with a pulp felt (by way of which it indirectly contacts the product concerned) or—in the case of a calender—directly with the product, against which it is pressed by a rotating roller.

In addition to the above-mentioned sliding properties of the back surface, another important factor is the impermeability of the belt to liquid, because water should not pass from the product or pulp felt to the pressing element, nor may lubricant from the latter enter the product or the felt. Furthermore, certain elasticity and flexibility characteristics are required.

Nip press belts of various designs are known in the state of the art.

For example, the patent EP 0 420 372 B1 describes a nip press belt of this generic kind with a basic web in the form of an endless loop covered on its inner and outer surfaces with a smooth polymer-resin coating, which makes the web impermeable to liquids and endows it with a uniform thickness. The polymer resin that forms the elastomer is here specified as polyurethane.

The patent DE 50 20 005 C1 discloses another band for use in paper machines, in particular wet presses with elongated nip (nip presses). The band has on its back surface a smooth, flexible band layer that is impermeable to liquids, and on the front surface there is a carrier tread with a fiber layer attached thereto.

The patent DE 42 02 731 A1 also discloses a belt, here termed "jacket", of this generic kind for a nip press, which comprises an elastomeric jacket material and two layers of reinforcing threads. As specification of the jacket material, reference is made here on one hand to material capable of swelling, and on the other hand to polyurethane.

In WO 95/16820 a paper-machine web—specifically a nip press belt—is described in which a carrier web with a polymer coating is provided, which comprises a thixotropic material (for example, aramid or silica glass). The base material specified here, again, is polyurethane.

Finally, the patent DE 44 38 354 A1 discloses another press jacket made of elastomeric material, in which is embedded substantially parallel to the surface a woven layer of an extremely stable material, for example aramid fibers.

From DE 299 23 825 U1 another press jacket or a press band or a roller coating for the paper, cellulose, tissue, printing or textile industry is known, which consists of a rubber-polymer and in which are embedded, in in order to increase the modulus of elasticity, natural and/or synthetic fibers oriented in the direction of travel.

Furthemore, in the applicant's older European patent application 01 109 618.7 a soft-rubber nip press belt with a textile reinforcing layer is described.

The objective of the invention is to provide a nip press belt, the working characteristics of which are improved in comparison to these known solutions, in particular with respect to optimized elasticity properties and advantageous multidimensional bending behavior, so as to obtain quiet running of the machinery combined with low driving power and a high total running time.

This objective is achieved by a nip press belt with the characteristics given in Claim 1. As a result of the invention there is also provided an improved wet press or an improved calender for the manufacture of paper, cardboard and tissue.

The invention includes the fundamental idea that the nip press belt is made of an extremely soft elastomer that conforms readily to other surfaces (and in addition is sufficiently economical), as a result of which the belt as a whole can be endowed with an unusually low bending moment and a low overall modulus of elasticity. The invention further includes the idea of constructing a nip press belt based on a substrate that can be used for a large number of applications, namely a unitary carrier layer made of soft rubber with integrated textile reinforcement, on which (or continuous with which) an elastomeric covering layer or wearing coat is formed. Finally, it is significant for the success of the invention that the mechanical properties of the elastomers that form the carrier layer and the covering layer are not too different from one another.

Achievement of the above-mentioned working characteristics, improved in several respects, results from the combination of these advantageously adjusted parameters.

In addition, the proposed construction offers the opportunity to select the material that forms the covering layer from a variety of suitable elastomers, each of which provides special advantages with respect to tolerance of changes in temperature, oil or degree of bending, or with respect to the quality of the belt surface (to allow the manufacture of particularly high-quality or specially structured paper surfaces). This measure eliminates practically all previous restrictions with respect to the surface design. The proposed nip press belt can continue to be employed in the case of future developments with regard to paper machines—for instance if, as expected, processing temperatures are raised—and can be optimally adjusted for practically any application that will arise.

In a first preferred embodiment the covering layer consists substantially of a polyurethane material known per se, the hardness of which here in particular (like that of the material of which the carrier layer consists) is in the range between 20 and 50 P+J. This PU wearing coat in particular enables optimization of the surface profile in accordance with the requirements of the specific application.

In an alternative embodiment, which in particular provides excellent tolerance of changes in temperature, oil and degree of bending, the covering layer consists substantially of soft rubber, the hardness of which is substantially the same as that of the soft rubber of which the carrier layer is made, and which can be formed so as to be continuous with the carrier layer.

In one advantageous embodiment the soft-rubber carrier layer and optionally provided soft-rubber covering layer of the belt comprise a rubber compound that is highly abrasionresistant, being made of several rubber or silicone-rubber composites. In particular, these composites are homogeneously mixed with one another in the compound.

The choice of a specific composition or compositions allows the hardness of the soft-rubber layer to be adjusted according to the requirements of the particular application, i.e. to suit the customer's desires. The hardness is preferably about 35 P+J.

In order to adjust the breaking strength of the belt to severe demands, a fiber reinforcement or an interlocking material is incorporated into the elastomer layer. This textile reinforcing component, according to the information currently available, preferably takes the form of strands oriented in the circumferential and/or longitudinal direction of the belt. It also seems reasonable to construct it as a nonwoven fabric of staple (short) fibers, either as an independent reinforcing layer or in combination with another type of reinforcement, such as the above-mentioned strands. The employment of a woven fabric as reinforcing layer is also possible.

As reinforcing material, in particular modified glass or carbon fibers can be used, or in particular highly stable plastic fibers. In the last case polyester and polyamide copolymers or aramid are the primary candidates. Depending on the customer's requirements, combinations or mixtures of these materials can usefully be employed.

The textile reinforcement is preferably incorporated near the back surface of the carrier layer in the elastomer-textile composite, first in order not to impair the elastic properties of the front surface of the belt, and also to ensure a minimal bending moment at the curved part of the pressing element and at the ends of the belt, and thus to achieve the intended overall optimization of the multidimensional curvature behavior.

In accordance with the customary specifications of paper machines, the thickness of the carrier layer is advantageously in the range between 4 and 6 mm, with a standard value of 5 mm, and the thickness of the covering layer can vary between about 2 and 6 mm. In view of this, the total thickness of the belt (chosen in accordance with the elasticity and stability properties of the individual materials) will in particular be in the range between 5 and 10 mm, the standard being ca. 7.5 mm.

The front surface of the belt can be made smooth, which will be particularly appropriate for use in a calender. However, specifically for use in a wet press, it can also have a well-defined structure. The structure that seems preferable at present consists of recesses in the form of pocket holes. These can in particular be approximately cylindrical in shape and isolated from one another. However, structures in which recesses are connected to one another, grooved structures and the like can also be useful.

Depending on the specific conditions of use, the open cross-sectional area of the structured front side (i.e., the total area occupied by the recesses) advantageously amounts to 10–50% of the total area of the front surface of the belt. For conventional wet-press applications, it seems appropriate for the openings to have an area equal to about 20% of the total. In particular, the recesses have lateral dimensions in the range between 0.5 and 5 mm, in particular between 1 and 3 mm. Their depth is advantageously in the same range.

According to a further essential aspect of the invention, the nip press belt has a stiffness or—converted to take account of cross section—bending stress distinctly below that of conventional belts. Thus the force required to achieve a deflection of 15 mm in a three-point bending test of a specimen 30 mm wide and 5 mm thick, set on supports 100 mm apart, is preferably 17 N or less, in particular 13 N or less, and the bending stress is below 110 N/cm$^2$ and in particular below 90 N/cm$^2$. In an embodiment of the belt in accordance with the invention that is preferred for practical purposes, a force of 11 N and a bending stress of 70 N/cm$^2$ was measured.

With such elasticity it contributes substantially to a saving of driving power and to quiet running of the associated wet press or calender, and this benefit is not offset by substantial restrictions with respect to the service life of the belt. On the contrary, the reduction of deformation-dependent strain in the material actually has a positive effect on the working or service life of the belt.

Figure 2:
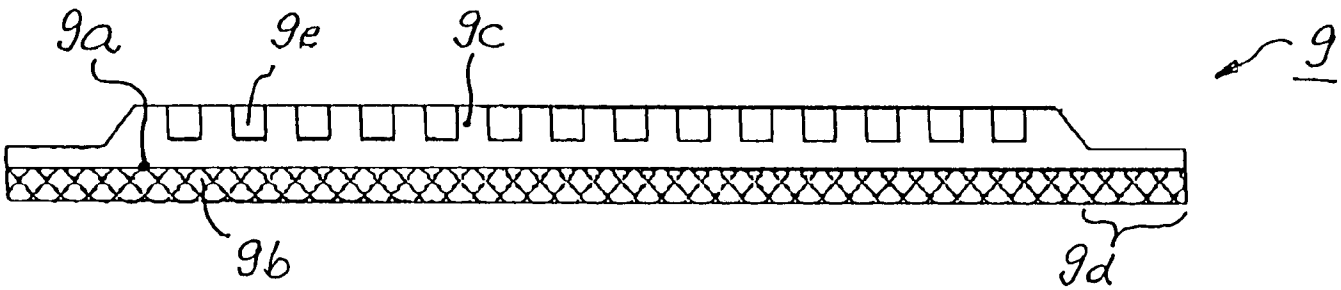

Other advantages and useful aspects of the invention will be apparent from the subordinate claims, as well as from the following description in outline of an exemplary embodiment with reference to the figures, wherein FIG. 1 is a schematic drawing of the wet-press section of a paper machine in longitudinal section, and FIG. 2 is a simplified cross-sectional drawing of an embodiment of the nip press belt of such a wet press, constructed in accordance with the invention.

FIG. 1 shows part of the nip of a wet press 1 (nip press) of a paper machine with elongated nip. Opposite a pressing element 3 is disposed a press-roller 5, and in the gap between these two, namely the nip 7, water is removed from a paper web 13 enclosed between the surface of the press-roller 5 and a nip press belt 9 that slides along the pressing element 3, with a pulp felt 11.

The nip press belt 9 must on one hand have elasticity and flexibility such that it conforms as well as possible to the curved surface of the pressing element 3 and exerts an elastic pressure uniformly upon the paper web 13 (by way of the pulp felt 11). On the other hand, it must be sufficiently stable to withstand the high, long-term stress (tension, pressure and vibration) in the nip 7 for a service time that is economically acceptable. The hardness of the soft rubber in the standard design is 35 P+J, but it can be varied within broad limits, as desired by the customer, by appropriate variation and mixing of rubber composites. The soft rubber can be used in the long term at temperatures above 100° C., and can tolerate temperature peaks of up to ca. 130° C.

The total area of the openings amounts to 20% of the area of the front surface of the belt or, alternatively, grooves (not shown) with comparable dimensions can be formed in the covering layer. To the carrier band 9*a* is fixedly connected a polyurethane wearing coat 9*c* made of a PU material, the hardness of which is likewise about 35 P+J and the mechanical properties of which thus are largely the same as those of the carrier band.

A nip press belt 9 suitable to meet these demands is shown (schematically) in cross section in FIG. 2. This nip press belt 9 has as its base a carrier band 9*a* made of soft rubber into which, near its back surface, is integrally incorporated a textile reinforcement 9*b* consisting of carbon fibers or modified glass fibers or aramid fibers. The overall thickness of the belt is 7.5 mm; in the region of the lateral lips 9*d* it is ca. 5 mm. In the free surface of the wearing coat 9*c* are formed pocket holes 9*e* with a diameter of 2.5 mm and a depth of 2 mm. The thickness of the carrier layer or carrier band 9*a* is 5 mm, and the thickness of the PU covering layer or wearing coat is 2.5 mm.

The embodiment of the invention is not restricted to this example, but is also possible in many modifications, with respect both to the materials of which the individual components are made and to the geometric dimensions.

LIST OF REFERENCE NUMERALS

1 Wet press
3 Pressing element
5 Press-roller
7 Nip
9 Nip press belt
9*a* Carrier band
9*b* Textile reinforcement
9*c* Wearing coat
9*d* Lateral lip
9*e* Pocket hole
11 Pulp felt
13 Paper web

What is claimed is:

1. Nip press belt of a wet press (1) or a calendar with elongated nip, in particular for a paper, cardboard or tissue machine comprising:

a flexible carrier layer (9*a*) that is impermeable to liquids and is made of soft rubber having a hardness in the range between 20 and 50 P+J and an integrated textile reinforcement (9*b*); and a covering layer (9*c*) fixedly connected to the carrier layer or formed together therewith, which consists substantially of soft rubber and has a hardness in the range between 20 and 50 P+J;

the belt being characterized in that in a three-point bending test of a specimen of the nip press belt 30 mm wide and 5 mm thick, set onto two supports 100 mm apart, the force that must be exerted to produce a deflection of 15 mm is 17 N or less, and the associated bending stress is 110 N/cm$^2$ or less.

2. Nip press belt according to claim 1, characterized in that the carrier layer (9*a*) and the soft-rubber covering layer (9*c*) comprise a rubber compound consisting of a plurality of rubber and/or silicone-rubber composites that are homogeneously mixed.

3. Nip press belt according to claim 1, characterized in that the textile reinforcement (9*b*) comprises modified glass fibers, carbon fibers and/or highly stable plastic fibers.

4. Nip press belt according to claim 1, characterized in that the textile reinforcement (9*b*) comprises threads oriented in the circumferential direction of the nip press belt.

5. Nip press belt according to claim 1, characterized in that the textile reinforcement (9*b*) comprises a nonwoven fabric of staple (short) fibers.

6. Nip press belt according to claim 1, characterized by the carrier layer (9*a*) and/or covering layer (9*c*) having a hardness of ca. 35 P+J.

7. Nip press belt according to claim 1, characterized by the covering layer (9*c*) having a structured front surface with recesses (9*e*).

8. Nip press belt according to claim 7, characterized in that the recesses (9*e*) have lateral dimensions and a depth in the range between 0.5 and 5 mm.

9. Nip press belt according to claim 8, characterized in that the open cross-sectional area of the structured front surface accounts for a proportion of between 10 and 50%, of the total area of the front surface.

10. Nip press belt according to claim 1, characterized in that the carrier layer (9*a*) has a thickness in the range between 4 and 6 mm, and the covering layer (9*c*) has a thickness in the range between 2 and 6 mm.

11. Nip press belt according to claim 1, characterized in that in the three-point test a force of 11 N is to be exerted.

12. Nip press (1) with an elongated nip of a paper, cardboard or tissue machine, with a nip press belt (9) according to claim 1.

13. Calender with elongated nip of a paper, cardboard or tissue machine, with a nip press belt according to claim 1.

14. A calender with elongated nip of a paper, cardboard or tissue machine, with a nip press belt comprising:

a flexible carrier layer that is impermeable to liquids and is made of soft rubber having a hardness in the range between 20 and 50 P+J and an integrated textile reinforcement; and a covering layer fixedly connected to the carrier layer or formed together therewith, which consists substantially of soft rubber and has a hardness in the range between 20 and 50 P+J.

* * * * *